US005976275A

United States Patent [19]

Yonezawa et al.

[11] Patent Number: 5,976,275

[45] Date of Patent: Nov. 2, 1999

[54] HIGH-NICKEL AUSTENITIC STAINLESS STEEL RESISTANT TO DEGRADATION BY NEUTRON IRRADIATION

[75] Inventors: Toshio Yonezawa; Toshihiko Iwamura; Hiroshi Kanasaki; Koji Fujimoto; Shizuo Nakada; Kazuhide Ajiki; Mitsuhiro Nakamura, all of Hyogo-ken, Japan

[73] Assignee: Mitsubishi Jukogyo Kabushiki Kaisha, Tokyo, Japan

[21] Appl. No.: 08/836,519

[22] PCT Filed: Aug. 30, 1996

[86] PCT No.: PCT/JP96/02442

§ 371 Date: Jun. 5, 1997

§ 102(e) Date: Jun. 5, 1997

[87] PCT Pub. No.: WO97/09456

PCT Pub. Date: Mar. 13, 1997

[30] Foreign Application Priority Data

Sep. 1, 1995 [JP] Japan ..... 7-225291
Aug. 29, 1996 [JP] Japan ..... 8-228254

[51] Int. Cl.[6] ..... C22C 38/00; C22C 38/302

[52] U.S. Cl. ..... 148/326; 148/327; 148/607; 148/608; 148/611; 420/43; 420/46; 420/47; 420/52; 420/53

[58] Field of Search ..... 148/325, 326, 148/327, 607, 608, 611; 420/43, 46, 47, 52, 53

[56] References Cited

U.S. PATENT DOCUMENTS 4,861,547 8/1989 Culling ..... 420/53
5,021,215 6/1991 Sawaragi et al. ..... 420/584.1

FOREIGN PATENT DOCUMENTS 119914 5/1945 Australia .
381121 8/1990 European Pat. Off. .
49098719 9/1974 Japan .
58-120766 7/1983 Japan .
361048530 3/1986 Japan .
62-44559 2/1987 Japan .
62-217190 9/1987 Japan .
64-11950 1/1989 Japan .
02247358 10/1990 Japan .
3-68737 3/1991 Japan .
3-97830 4/1991 Japan .
406136442 5/1994 Japan .
07228955 8/1995 Japan .
1295889 11/1972 United Kingdom .

OTHER PUBLICATIONS

Patent Abstracts of Japan, vol. 008, No. 118 (C–226), May 31, 1984 & JP 59 031822A (Kobe Seikosho KK), Feb. 21, 1984.

Patent Abstracts of Japan, vol. 018, No. 443 (C–1239), Aug. 18, 1994 & JP 06 136442A (Sumitomo Metal Ind Ltd), May 17, 1994.

*Primary Examiner*—Sikyin Ip
*Attorney, Agent, or Firm*—Wenderoth, Lind & Ponack, LLP

[57] ABSTRACT

The present invention aims at providing structural materials having a resistance to degradation by neutron irradiation, causing no SCC in an environment of light-water reactors even after subjecting the materials to neutron irradiation of approximately at least $1\times10^{22}$ n/cm$^2$ (E>1 MeV), and having thermal expansion coefficients approximately similar to that of structural materials. The high nickel austenitic stainless steels of the present invention having a resistance to degradation by neutron irradiation can be produced by subjecting stainless steels having compositions (by weight %) of 0.005 to 0.08% of carbon, at most 0.3% of Mn, at most 0.2% of (Si+P+S), 25 to 40% of Ni, 25 to 40% of Cr, at most 3% of Mo or at most 5% of (Mo+W), at most 0.3% of Nb+Ta, at most 0.3% of Ti, at most 0.001% of B and the balance of Fe to a solution-annealing treatment at a temperature of 1000 to 1150° C.

8 Claims, 3 Drawing Sheets

HIGH-NICKEL AUSTENITIC STAINLESS STEEL RESISTANT TO DEGRADATION BY NEUTRON IRRADIATION

BACKGROUND OF THE INVENTION

1. Field of the Invention

This invention relates to high nickel austenitic stainless steels having an excellent resistance to degradation by neutron irradiation, which are used as structural materials for nuclear power plants of light-water reactors.

2. Description of the Related Art

Up to the present time, it has been known that when austenitic stainless steels such as SUS 304, 316, etc., having been used as structural materials for nuclear power plants of light-water reactors, are used for a long time and subjected to neutron irradiation of at least $1\times10^{21}$ n/cm$^2$ (E>1 MeV), Cr depletes and Ni, Si, P, S, etc. enrich, at crystal grain boundaries, resuiting in tendency of causing stress corrosion cracking (SCC) in the presence of a high load stress in an environment of light-water reactors. This is called "irradiation assisted stress corrosion cracking" (IASCC). It has eagerly been desired to develop materials with low IASCC susceptibility, but such low IASCC susceptibility materials (excellent resistance to degradation by neutron irradiation) have not been developed yet.

Austenitic stainless steels such as SUS 304, 316, etc., have been used as structural materials for nuclear power plants of light-water reactors, but when these materials are subjected to neutron irradiation of at least $1\times10^{21}$ n/cm$^2$ (E>1 MeV) by using for a long time, change of concentrations of elements further proceeds, which do not or hardly occurs before using. That is, it is known that when Cr depletes and Ni, Si, P, S, etc. enrich at crystal grain boundaries (which will hereinafter be referred to as "radiation induced segregation") and there is a high load stress or residual stress, the stress corrosion cracking (irradiation assisted stress corrosion cracking, IASCC) tends to occur in the high temperature and pressure water of a neutron irradiation environment in light-water. Furthermore, it is known that the presence of oxygen in a large amount in high temperature and pressure water accelerates generation of IASCC.

Thus, the inventors have made various studies on properties of stainless steels and as a result of comparison of the inventors' calculation results on the change quantity of concentrations of Cr and Ni at crystal grain boundaries, based on S. Dumbill and W. Hanks' measured values of the crystal grain boundary segregation of neutron irradiated materials (Sixth International Symposium on Environmental Degradation of Materials in Nuclear Power Systems-Water Reactors, 1993, p. 521) with the inventors' accumulated SCC test results of neutron-irradiated SUS 304, 316, etc., it is found that the above described IASCC occurs when, at grain boundaries after neutron irradiation, the amount of Cr is at most 15% and the amount of Ni is at least 20%, as shown in FIG. 2, in which slant line part shows an occurrence zone of SCC.

The inventors have considered that such a phenomenon of occurrence of IASCC is due to the fact that concentrations of elements at crystal grain boundaries are similar to a composition of Alloy 600 (NCF 600 of JIS). Namely, IASCC is considered to be probably due to the fact that compositions at crystal grain boundaries get low Cr and high Ni by the neutron irradiation thereby approaching the composition of Alloy 600 (non-irradiated material) and resulting in stress corrosion cracking (PWSCC: primary water stress corrosion cracking) in water at a high temperature and pressure which often takes place in Alloy 600. At the present time, however, the mechanism of occurrence of PWSCC in Alloy 600 has not been elucidated.

The inventors have made studies based on the above described knowledge and reached the present invention by specifying a composition of a suitable material and simultaneously, combining it with a heat treatment and post working method for rendering optimum a crystal form in an alloy.

That is to say, present invention aims at providing structural materials having a resistance to degradation by the neutron irradiation, resulting in no SCC in environments of light-water reactors (in high temperature and pressure water or in high temperature and pressure water saturated with oxygen) even after subjecting the materials to neutron irradiation of approximately at least $1\times10^{22}$ n/cm$^2$ (E>1 MeV). This corresponds to the quantity of maximum neutron irradiation received up to the end of the plant life of light-water reactors and having a thermal expansion coefficient approximately similar to that of SUS 304, 316, etc.

SUMMARY OF THE INVENTION

This invention provides:

(1) High nickel austenitic stainless steels having a resistance to degradation by neutron irradiation, which have excellent resistance to stress corrosion cracking in high temperature and pressure water of 270~350° C./70~160 atm or in high temperature and pressure water saturated with oxygen even after being subjected to neutron irradiation of at least $1\times10^{22}$ n/cm$^2$ (E>1 MeV), and whose average thermal expansion coefficient from room temperature to 400° C. is in a range of $15\times10^{-6}$~$19\times10^{-6}$/K, (2) High nickel austenitic stainless steels having a resistance to degradation by neutron irradiation, which comprise a stainless steel having compositions (by weight %) of 0.005 to 0.08% of carbon, at most 0.3% of Mn, at most 0.2% of Si+P+S, 25 to 40% of Ni, 25 to 40% of Cr, at most 3% of Mo, at most 0.3% of Nb+Ta, at most 0.3% of Ti, at most 0.001% of B and the balance of Fe, said stainless steels being subjected to a solution-annealing treatment at a temperature of 1000 to 1150 ° C., (3) High nickel austenite stainless steels having a resistance to degradation by neutron irradiation, which comprise a stainless steel having compositions (by weight %) of 0.005 to 0.08% of carbon, at most 0.3% of Mn, at most 0.2% of Si+P+S, 25 to 40% of Ni, 25 to 40% of Cr, at most 5% of Mo+W, at most 0.3% of Nb+Ta, at most 0.3% of Ti, at most 0.001% of B and the balance of Fe, said stainless steels being subjected to solution-annealing treatment at a temperature of 1000 to 1150° C., (4) High nickel austenite stainless steels having a resistance to degradation by neutron irradiation, as described in the foregoing (2) or (3), wherein a cold working up to 30% is carried out after the above described solution-annealing treatment, (5) High nickel austenite stainless steels having a resistance to degradation by neutron irradiation, as described in any one of the foregoing (2) to (4), wherein a heat treatment for a period of up to 100 hours is carried out at 600 to 750° C. after the above described solution-annealing heat treatment or cold working, (6) A process for the production of high nickel austenitic stainless steels having a resistance to degradation by neutron irradiation, which comprises subjecting stainless steels having compositions (by weight %) of 0.005 to 0.08% of carbon, at most 0.3% of Mn, at most 0.2% of Si+P+S, 25 to 40% of Ni, 25 to 40% of Cr, at most 3% of Mo, at most 0.3% of Nb+Ta, at most 0.3% of Ti, at most 0.001% of B and the balance of Fe to a solution-annealing treatment at a temperature of 1000 to 1150° C., (7) A process for the production of high nickel austenitic stainless steels having a resistance to degradation by the neutron irradiation, which comprises subjecting stainless steels having compositions (by weight %) of 0.005 to 0.08% of carbon, at most 0.3% of Mn, at most 0.2% of Si+P+S, 25 to 40% of Ni, 25 to 40% of Cr, at most 5% of Mo+W, at most 0.3% of Nb+Ta, at most 0.3% of Ti, at most 0.001% of B and the balance of Fe to a solution-annealing treatment at a temperature of 1000 to 1150° C., (8) A process for the production of high nickel austenitic stainless steels having a resistance to degradation by neutron irradiation, as described in the foregoing (6) or (7), wherein a cold working up to 30% is carried out after the above described solution-annealing treatment and (9) A process for the production of high nickel austenitic stainless steels having a resistance to degradation by the neutron irradiation, as described in any one of the foregoing (6) to (8), wherein a heat treatment for a period of up to 100 hours is carried out at 600 to 750° C. after the above described solution-annealing treatment or cold working.

DETAILED DESCRIPTION OF THE PREFERRED EMBODIMENTS

Figure 1:
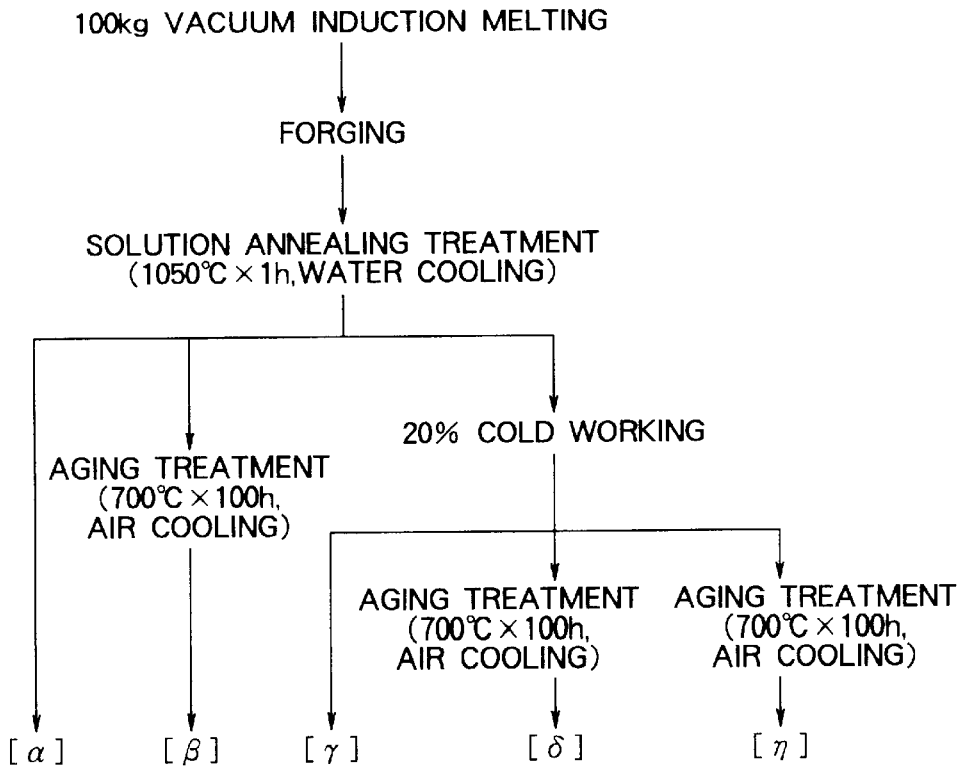
FIG. 1 is a flow sheet showing a process for the production of a test piece used in Example.

High nickel austenitic stainless steels having a resistance to degradation by neutron irradiation according to the present invention are materials having the excellent SCC resistance in an environment of light-water reactors, i.e. in high temperature and high pressure water approximately at 270 to 350° C./70 to 160 atm and in high temperature and pressure water saturated with oxygen, even after neutron irradiation of up to at least $1\times10^{22}$ n/cm$^2$ (E>1 MeV), and having a thermal expansion coefficient in a range of $15\times10^{-6}$~$19\times10^{-6}$/K, near $18\times10^{-6}$~$19\times10^{-6}$/K corresponding to an average thermal expansion coefficient of SUS 304 or 316 having hitherto been used of from room temperature to 400° C., which can be produced favorably on a commercial scale by the foregoing production processes (6) to (7), for example, by the flow sheet as shown in FIG. 1.

As high nickel austenitic stainless steels having a resistance to degradation by neutron irradiation, provided with such properties, in a case where the environment is of high temperature and pressure water, there are high nickel austenitic stainless steels having a resistance to degradation by neutron irradiation, which comprise stainless steels having compositions (by weight %) of 0.005 to 0.08%, preferably 0.01 to 0.05% of carbon, at most 0.3% of Mn, at most 0.2% of Si+P+S, 25 to 40% of Ni, 25 to 40% of Cr, at most 3% of Mo, at most 0.3% of Nb+Ta, at most 0.3% of Ti, at most 0.001% of B and the balance of Fe, said stainless steels being subjected to a solution-annealing treatment at a temperature of 1000 to 1150° C., whereby solute atoms in the alloy are completely dissolved in the matrix.

In a case where the environment is of high temperature and pressure water saturated with oxygen, moreover, there are high nickel austenitic stainless steels having a resistance to degradation by neutron irradiation, which comprise stainless steels having compositions (by weight %) of 0.005 to 0.08%, preferably 0.01 to 0.05% of carbon, at most 0.3% of Mn, at most 0.2% of Si+P+S, 25 to 40% of Ni, 25 to 40% of Cr, at most 5% of Mo+W, at most 0.3% of Nb+Ta, at most 0.3% of Ti, at most 0.001% of B and the balance of Fe, said stainless steels being subjected to solution-annealing treatment at a temperature of 1000 to 1150° C., whereby solute atoms in the alloy are completely dissolved in the matrix.

In these stainless steels, there are precipitated $M_{23}C_6$ (carbide in which M is predominantly Cr) coherent with matrix in crystal grain boundaries. Crystal grain boundaries are strengthened by coherent precipitation of $M_{23}C_6$ in the crystal grain boundaries to improve the SCC resistance.

Furthermore, if necessary, high nickel austenitic stainless steels having been subjected to the above described solution-annealing treatment can be subjected to a cold working of up to at most 30% at a temperature range of at most the recrystallization temperature and dislocations due to slip deformation in crystal grains are increased to raise the strength as bolt materials without losing the SCC resistance. After the above described cold working, a heat treatment (aging treatment) is carried out at 600 to 750° C. and thus $M_{23}C_6$ coherent with matrix can sufficiently be precipitated in crystal grain boundaries, thereby improving the SCC resistance. For the purpose of the present invention, the cold working can lightly be effected to an extent of at most 30%. The heat treatment (aging treatment) of up to 600 to 750° C. is effective for a period of about up to 100 hours.

Figure 2:
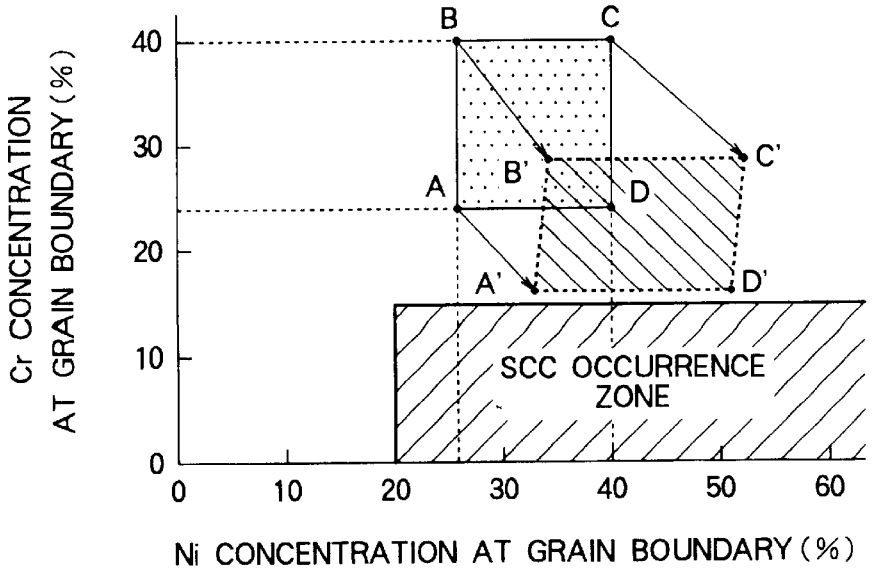
FIG. 2 is a graph showing a relationship between Cr and Ni concentrations and SCC susceptibility at crystal grain boundaries of an alloy, assumed from measured values of crystal grain boundaries segregation of neutron-irradiated materials.

The reason for specifying the composition range as described above (percent is to be taken as that by weight in the following composition) is as follows:

As a result of studying the relationship between such a phenomenon that materials are degraded by neutron irradiation, that is, the quantity of Cr depletes and that of Ni enriches at grain boundaries with the stress corrosion cracking and susceptibility under an environment of light-water reactors, it is found that SCC occurs when the quantities of Cr and Ni at the grain boundaries are within a range of slant lines as shown in FIG. 2. Since a quantity of neutron irradiation, a high stress-loaded part receives among core parts of light-water reactors until the end of the plant life, is approximately at most $1\times10^{22}$ n/cm$^2$ (E>1 MeV), the inventors have tried to obtain a required initial value of Cr quantity (before neutron irradiation) for such an alloy that the quantities of Cr and Ni are not within the range of slant lines in FIG. 2 even if subjected to neutron irradiation of $1\times10^{22}$ n/cm$^2$, from the quantities of change of the Cr and Ni concentrations at crystal grain boundaries, based on the measured values of crystal grain boundaries segregation of neutron-irradiated materials, having been reported. Consequently, it is found that the initial value must be at least 25%. The quantity of Cr should preferably be increased, but if too increased, ductility is lowered to deteriorate casting property, so the upper value is preferably adjusted to 40%.

Figure 3:
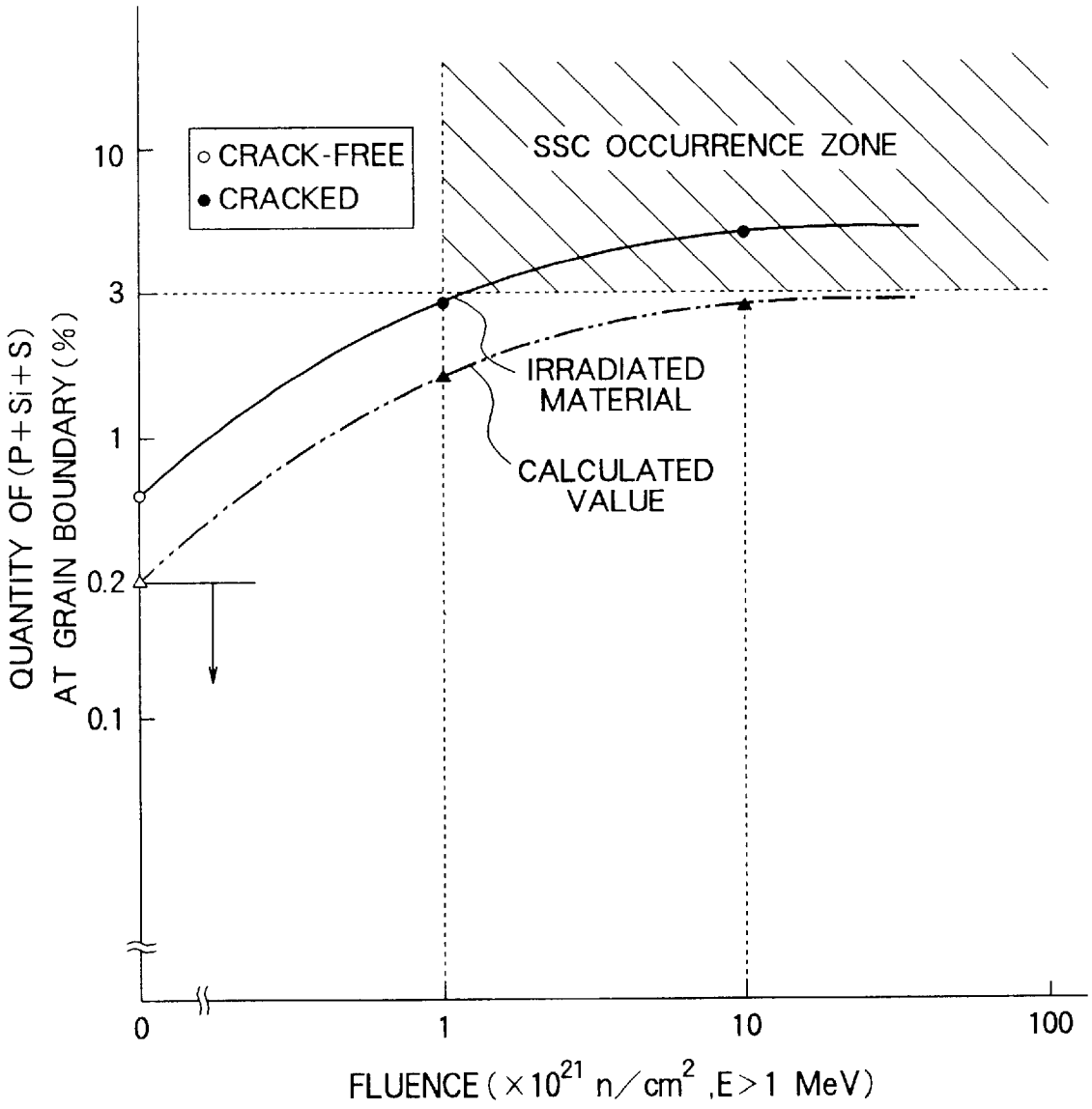
FIG. 3 is a graph showing a relationship between a fluence of a neutron-irradiated stainless steel and a quantity of (Si+P+S) at crystal grain boundaries thereof and FIG. 4 is a schematic view of a shape and dimension of a test piece used in a SCC accelerating test.

In the case of preparing an alloy containing at least 25% of Cr, it is required to adjust a content of Ni to 25 to 40% so that the austenitic phase may be stable and the thermal expansion coefficient may approach that of SUS 304 ($17\times10^{-6}$/K). In FIG. 2, an area ABCD represents the concentrations of Cr and Ni before the neutron irradiation, while an area A'B'C'D' represents the concentrations at crystal grain boundaries after receiving a neutron irradiation of $1\times10^{22}$ n/cm$^2$ (E>1 MeV). When a relationship between such a phenomenon that materials are degraded by the neutron irradiation namely, the quantities of Si, P and S are enriched at grain boundaries and such a phenomenon that the SCC susceptibility in an environment of light-water reactors is increased has been investigated, for example, it is found that SCC tends to occur in a case where the sum of the quantities of Si, P and S at grain boundaries of SUS 316 is at least 3% as shown in FIG. 3. It will clearly be understood from FIG. 3 that the initial value of the quantities of Si, P and S sums to at most 0.2%, from a calculation result from the quantities of change of the Cr and Ni concentrations at crystal grain boundaries, based on the measured values of crystal grain boundaries segregation of a neutron irradiated material, having been reported, through such an initial value (before neutron irradiation) that the sum of the quantities of Si, P and S is not more than 3% even if subjected to neutron irradiation of about $1\times10^{22}$ n/cm$^2$ (E>1 MeV) as the maximum value of a quantity of the neutron irradiation, a high stress-loaded part receives among core parts of a light-water reactors until the end of the plant life.

A quantity of C should be 0.005 to 0.08%, preferably 0.01 to 0.05%, since if less than 0.005%, precipitation of $M_{23}C_6$ excellent in SCC resistance does not sufficiently take place, while if more than 0.08%, reversely precipitation of carbides is increased and the corrosion resistance is decreased as the concentration of Cr at crystal grain boundaries.

Even if Mo as another component is not added, structural materials for reactors can be used, but in order to further improve the corrosion reistance, Mo is preferably added with an upper limit of 3% corresponding to at most the content level of SUS 316. The addition of Mo even in micro amount is effective for repassivation of a surface coating film. A preferred addition range thereof is 1 to 2%, whereby the toughness at a low temperature can be improved, but the addition of Mo exceeding 3% accelerates precipitation of intermetallic compounds and 6 phase, resulting in embrittlement of the material and marked deterioration of the workability and welding property thereof. This is not perferable.

Furthermore, in order to improve the SCC resistance in high temperature and pressure water saturated with oxygen, Mo+W is specified in at most 5% with such a provision that Mo does not exceed 3%. Particularly, Mo improves the corrosion resistance as described above, and when the addition amount thereof is further increased, a locallized corrosion occurring in crevice formed during using stainless steels in high temperature and pressure water saturated with oxygen, that is, the crevice corrosion is moderated. A preferred amount is 2 to 3%. W has a similar effect to Mo and is capable of improving the corrosion resistance in an amount of 0.1 to 1%. Accordingly, the addition amount of Mo+W should be at most 5%, and it is preferable to specify the upper limit thereof in 4% for the purpose of obtaining production stability.

Amounts of Nb+Ta and Ti are specified in at most 0.3 weight %, corresponding to at most an impurity level in the case of using them as a deoxidizer, and amounts of Mn and B are specified in a possible minimum value in practice from the steel making technique at the present time. The amount of Mn is at most 0.3%, preferably at most 0.1% and that of B is at most 0.001%. Nb+Ta, Ti, Mn and B are optional components and may respectively be 0.

In the present invention, compositions of the material and metallic texture are previously controlled so that the material degrades to such an extent as hardly causing IASCC even if it is exposed to neutron irradiation, based on the knowledge that the irradiation assisted stress corrosion cracking (IASCC) occurs superimpopsedly with degradation of the material by a high load stress and a neutron irradiation.

It has been known that IASCC, as grain boundary cracking, takes place due to that Cr depletes and Ni, Si, P, S, etc. enrich at grain boundaries. The feature of the present invention consist in that ① an amount of Cr is previously and adequately increased so that IASCC may not occur even if Cr depletes in grain boundaries by the neutron irradiation and ② amounts of impurities such as Si, P, S, etc. are previously and adequately decreased so that IASCC may not occur even if Si, P, S, etc. enrich in grain boundaries by the neutron irradiation. Moreover, it is found as a result of the inventors' studies from the knowledge that IASCC is related with precipitated carbides at grain boundaries that the feature consists in that ③ precipitated carbides at grain boundaries are previously maintained so that IASCC be hard to occur and ④ such an alloy composition as described above is specified and the thermal expansion coefficient is not so largely changed from that of the prior conventional materials even if a heat treatment is effected.

EXAMPLE

Figure 4A:
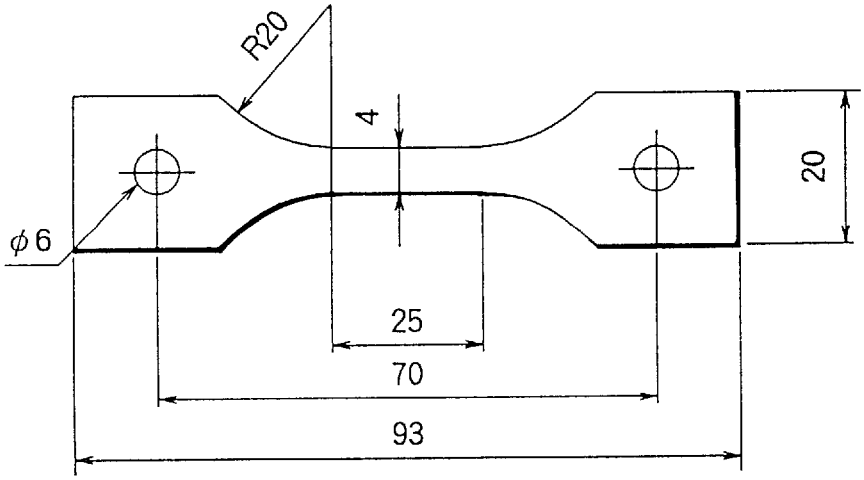
Figure 4B:
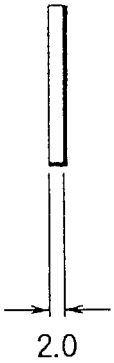

From the foregoing point of view, a test piece having a shape and dimension as shown in FIG. 4 (numeral in FIG. 4 : mm) was prepared using materials having chemical compositions shown in Tables 1 to 4 according to steps shown in FIG. 1 and then subjected to neutron irradiation up to a fluence of $5\times10^{22}$ n/cm$^2$ (E>1 MeV) at 320° C. using a nuclear reactor for a material test. Test pieces (Sample ①) with compositions of Tables 1 and 2 were subjected to an SCC accelerating test under a simulated environment in light-water reactors (in high temperature and pressure water, 360° C., 160 kgf/cm$^2$G, strain rate: 0.5 $\mu$m/min) and Test pieces (Sample ②) with compositions of Tables 3 and 4 were subjected to an SCC accelerating test under a simulated environment in light-water reactors (in high temperture and pressure water saturated with oxygen, oxygen concentration: 8 ppm, 290° C., 70 kgf/cm$^2$G, strain rate: 0.5 $\mu$m/min), thus obtaining results as shown in Tables 5 and 6. Mean thermal expansion coefficients of from room temperature to 400° C. of the resulting test pieces were all within a range of from $15.8\times10^{-6}$ to $17.1\times10^{-6}$/K. In Tables 5 and 6, "IGSCC"

means intergranular stress corrosion cracking and "IGSCC Fracture Surface Ratio" is a value represented by [(Σ Fracture Surface in Crystal Grain Boundaries)/(Σ Cross Sectional Area of Test Piece)]×100%. "SSRT" represents a slow strain tensile test.

Tables 5 and 6 teach that the material is most suitable when the value of Fracture Surface Ratio (IGSCC Fracture Surface Ratio), which can be considered as having the largest effect from a point of view of IASCC resistance, unlimitedly approaches 0, preferably at most 2% and it can be understood from this aspect that the amount of C should be 0.01 to 0.08%, preferably 0.03 to 0.05% and the amount of Cr is the larger, the better. In addition, it is desirable that Mo does not exceed 3% in high temperature and pressure water of Table 5 and Mo+W is added in an amount of about 3 to 4% in high temperature and pressure water saturated with oxygen of Table 6. P, S, Si, Nb, Ta, Ti and B are preferably added in less amounts.

The heat treatment is carried out in such a manner that $M_{23}C_6$ is coherently precipitated with matrix in crystal grain boundaries. In this Example, samples were prepared by subjecting to only solution-annealing treatment at 1050° C. for 1 hour as shown in FIG. 1 (Heat Treatment [α]), by subjecting, after the solution-annealing treatment, to an aging treatment at 700° C. for 100 hour (Heat Treatment [β]), by subjecting, after the solution-annealing treatment, to a cold working of about 20% (Heat Treatment [γ]), by further subjecting, after the Heat Treatment [γ], to an aging treatment at 700° C. for 10 hours (Heat Treatment [δ]), or to an aging treatment at 700° C. for 100 hours (Heat Teatment [η]). As shown in Tables 5 and 6, any of these samples showed a small IGSCC Fracture Surface Ratio in SSRT Test, i.e. excellent SCC resistance.

TABLE 1

Chemical Composition (1) of Sample ①

| Sample | | Chemical Composition C | Si | Mn | P | S | Ni | Cr | Mo | W | Nb + Ta | Ti | B | Heat Treatment Conditions (Cf. FIG. 1) |
|---|---|---|---|---|---|---|---|---|---|---|---|---|---|---|
| Sample No. | A1 | 0.001 | 0.09 | 0.09 | 0.001 | 0.001 | 30 | 28 | 1.5 | — | 0.15 | 0.10 | 0.0003 | α |
| | A2 | 0.01 | 0.08 | 0.09 | 0.002 | 0.002 | 31 | 28 | 1.2 | — | 0.16 | 0.15 | 0.0004 | α |
| | A3 | 0.03 | 0.09 | 0.08 | 0.001 | 0.002 | 30 | 29 | 1.4 | — | 0.17 | 0.10 | 0.0005 | α, β, γ, δ, η |
| | A4 | 0.05 | 0.09 | 0.08 | 0.001 | 0.001 | 31 | 28 | 1.5 | — | 0.14 | 0.13 | 0.0003 | α, β, γ, δ, η |
| | A5 | 0.08 | 0.08 | 0.09 | 0.001 | 0.002 | 31 | 28 | 1.3 | — | 0.15 | 0.12 | 0.0004 | α, β, γ, δ, η |
| | A6 | 0.05 | 0.09 | 0.08 | 0.002 | 0.002 | 30 | 20 | 1.4 | — | 0.16 | 0.10 | 0.0003 | α, β, γ, δ, η |
| | A7 | 0.05 | 0.08 | 0.09 | 0.001 | 0.001 | 31 | 25 | 1.5 | — | 0.13 | 0.11 | 0.0003 | α, β, γ, δ, η |
| | A8 | 0.05 | 0.08 | 0.08 | 0.002 | 0.002 | 31 | 30 | 1.4 | — | 0.14 | 0.12 | 0.0003 | α, β, γ, δ, η |
| | A9 | 0.05 | 0.08 | 0.09 | 0.001 | 0.001 | 35 | 40 | 1.5 | — | 0.13 | 0.11 | 0.0005 | α, β, γ, δ, η |
| | A10 | 0.05 | 0.08 | 0.08 | 0.001 | 0.001 | 30 | 29 | 1.5 | — | 0.65 | 0.12 | 0.0003 | α |
| | A11 | 0.05 | 0.08 | 0.08 | 0.001 | 0.001 | 30 | 29 | 3.5 | — | 0.15 | 0.11 | 0.0003 | α |
| | A12 | 0.05 | 0.08 | 0.09 | 0.001 | 0.001 | 30 | 29 | 1.5 | — | 0.14 | 0.5 | 0.0003 | α |
| | A13 | 0.05 | 0.08 | 0.08 | 0.001 | 0.001 | 30 | 29 | 0.03 | — | 0.01 | 0.01 | 0.0003 | α |
| | A14 | 0.05 | 0.76 | 1.50 | 0.008 | 0.008 | 30 | 29 | 1.5 | — | 0.10 | 0.10 | 0.0003 | α |

TABLE 2

Chemical Composition (2) of Sample ①

| Sample | | Chemical Composition C | Si | Mn | P | S | Ni | Cr | Mo | W | Nb + Ta | Ti | B | Heat Treatment Conditions (Cf. FIG. 1) |
|---|---|---|---|---|---|---|---|---|---|---|---|---|---|---|
| Sample No. | A15 | 0.05 | 0.23 | 0.60 | 0.001 | 0.001 | 30 | 28 | 1.5 | — | 0.14 | 0.11 | 0.0003 | α |
| | A16 | 0.05 | 0.10 | 0.50 | 0.008 | 0.007 | 30 | 28 | 1.5 | — | 0.14 | 0.15 | 0.0003 | α |
| | A17 | 0.05 | 0.23 | 0.08 | 0.008 | 0.008 | 30 | 28 | 1.5 | — | 0.14 | 0.15 | 0.0003 | α |
| | A18 | 0.05 | 0.08 | 0.09 | 0.001 | 0.001 | 30 | 29 | 0.03 | — | 0.01 | 0.01 | 0.0015 | α |
| | A19 | 0.05 | 0.08 | 0.09 | 0.001 | 0.001 | 30 | 28 | 1.5 | — | 0.15 | 0.14 | 0.0016 | α |
| Reference | B3 | 0.03 | 0.09 | 0.08 | 0.001 | 0.002 | 30 | 29 | 3.0 | 0.4 | 0.17 | 0.1 | 0.0005 | α |
| Sample No. | B4 | 0.05 | 0.09 | 0.08 | 0.001 | 0.001 | 31 | 28 | 3.0 | 0.5 | 0.14 | 0.13 | 0.0003 | α |
| | B5 | 0.08 | 0.08 | 0.09 | 0.001 | 0.002 | 30 | 28 | 3.0 | 0.3 | 0.15 | 0.12 | 0.0004 | α |
| SUS | 304 | 0.06 | 0.55 | 1.52 | 0.02 | 0.021 | 8 | 18 | — | — | — | — | — | α |
| | 316 | 0.04 | 0.75 | 1.65 | 0.018 | 0.011 | 13 | 18 | 2.6 | — | — | — | — | α |

TABLE 3

Chemical Composition (1) of Sample ②

| Sample | | Chemical Composition C | Si | Mn | P | S | Ni | Cr | Mo | W | Nb + Ta | Ti | B | Heat Treatment Conditions (Cf. FIG. 1) |
|---|---|---|---|---|---|---|---|---|---|---|---|---|---|---|
| Sample No. | B1 | 0.001 | 0.09 | 0.09 | 0.001 | 0.001 | 30 | 28 | 3.0 | 0.5 | 0.15 | 0.10 | 0.0003 | α |
| | B2 | 0.01 | 0.08 | 0.09 | 0.002 | 0.002 | 31 | 28 | 3.0 | 0.2 | 0.16 | 0.15 | 0.0004 | α |
| | B3 | 0.03 | 0.09 | 0.08 | 0.001 | 0.002 | 30 | 29 | 3.0 | 0.4 | 0.17 | 0.10 | 0.0005 | α, β, γ, δ, η |
| | B4 | 0.05 | 0.09 | 0.08 | 0.001 | 0.001 | 31 | 28 | 3.0 | 0.5 | 0.14 | 0.13 | 0.0003 | α, β, γ, δ, η |
| | B5 | 0.08 | 0.08 | 0.09 | 0.001 | 0.002 | 30 | 28 | 3.0 | 0.3 | 0.15 | 0.12 | 0.0004 | α, β, γ, δ, η |
| | B6 | 0.05 | 0.08 | 0.08 | 0.002 | 0.002 | 31 | 20 | 3.0 | 0.4 | 0.16 | 0.10 | 0.0003 | α, β, γ, δ, η |
| | B7 | 0.05 | 0.09 | 0.09 | 0.001 | 0.001 | 31 | 25 | 3.0 | 0.5 | 0.13 | 0.11 | 0.0003 | α, β, γ, δ, η |
| | B8 | 0.05 | 0.09 | 0.08 | 0.002 | 0.002 | 35 | 30 | 3.0 | 0.4 | 0.14 | 0.12 | 0.0003 | α, β, γ, δ, η |
| | B9 | 0.05 | 0.09 | 0.09 | 0.001 | 0.001 | 30 | 40 | 3.0 | 0.5 | 0.13 | 0.11 | 0.0005 | α, β, γ, δ, η |
| | B10 | 0.05 | 0.08 | 0.08 | 0.001 | 0.001 | 30 | 29 | 3.0 | 0.3 | 0.65 | 0.12 | 0.0003 | α |
| | B11 | 0.05 | 0.08 | 0.08 | 0.001 | 0.001 | 30 | 28 | 5.0 | 0.5 | 0.15 | 0.11 | 0.0003 | α |
| | B12 | 0.05 | 0.09 | 0.09 | 0.001 | 0.001 | 30 | 29 | 0.02 | 0.01 | 0.14 | 0.5 | 0.0003 | α |
| | B13 | 0.05 | 0.08 | 0.08 | 0.001 | 0.001 | 30 | 28 | 3.0 | 0.5 | 0.01 | 0.01 | 0.0003 | α |
| | B14 | 0.05 | 0.09 | 1.50 | 0.008 | 0.008 | 30 | 29 | 3.0 | 0.4 | 0.10 | 0.10 | 0.0003 | α |

TABLE 4

Chemical Composition (2) of Sample ②

| Sample | | Chemical Composition C | Si | Mn | P | S | Ni | Cr | Mo | W | Nb + Ta | Ti | B | Heat Treatment Conditions (Cf. FIG. 1) |
|---|---|---|---|---|---|---|---|---|---|---|---|---|---|---|
| Sample No. | B15 | 0.05 | 0.09 | 0.60 | 0.001 | 0.001 | 30 | 28 | 3.0 | 0.6 | 0.14 | 0.11 | 0.0003 | α |
| | B16 | 0.05 | 0.08 | 0.50 | 0.008 | 0.007 | 30 | 28 | 3.0 | 0.5 | 0.14 | 0.15 | 0.0003 | α |
| | B17 | 0.05 | 0.23 | 0.08 | 0.008 | 0.008 | 30 | 28 | 3.0 | 0.3 | 0.14 | 0.15 | 0.0003 | α |
| | B18 | 0.05 | 0.09 | 0.09 | 0.001 | 0.001 | 30 | 29 | 0.02 | 0.01 | 0.14 | 0.01 | 0.0015 | α |
| | B19 | 0.05 | 0.08 | 0.09 | 0.001 | 0.001 | 30 | 28 | 3.0 | 0.3 | 0.15 | 0.14 | 0.0016 | α |
| | B20 | 0.05 | 0.1 | 0.09 | 0.001 | 0.001 | 31 | 29 | 5.0 | 0.2 | 0.13 | 0.10 | 0.0003 | α |
| Reference | A3 | 0.03 | 0.09 | 0.08 | 0.001 | 0.002 | 30 | 29 | 1.4 | — | 0.17 | 0.1 | 0.0005 | α |
| Sample No. | A4 | 0.05 | 0.09 | 0.08 | 0.001 | 0.001 | 31 | 28 | 1.5 | — | 0.14 | 0.13 | 0.0003 | α |
| | A5 | 0.08 | 0.08 | 0.09 | 0.001 | 0.002 | 31 | 28 | 1.3 | — | 0.15 | 0.12 | 0.0004 | α |
| SUS | 304 | 0.06 | 0.55 | 1.52 | 0.02 | 0.021 | 8 | 18 | — | — | — | — | — | α |
| | 316 | 0.04 | 0.75 | 1.65 | 0.018 | 0.011 | 13 | 18 | 2.6 | — | — | — | — | α |

TABLE 5

SCC Test Results of Sample ① After Neutron Irradiation (320° C., $5 \times 10^{22}$ n/cm$^2$, E > 1 MeV)
(SSRT in High Temperature and Pressure Pure Water: 360° C., 160 kgf/cm$^2$G, strain rate 0.5 μm/min)

| Sample | | Heat Treatment α IGSCC Fracture Surface Ratio (%) | Fractue Time (h) | Heat Treatment β IGSCC Fracture Surface Ratio (%) | Fractue Time (h) | Heat Treatment γ IGSCC Fracture Surface Ratio (%) | Fractue Time (h) | Heat Treatment δ IGSCC Fracture Surface Ratio (%) | Fractue Time (h) | Heat Treatinent η IGSCC Fracture Surface Ratio (%) | Fractue Time (h) |
|---|---|---|---|---|---|---|---|---|---|---|---|
| Sample No. | A1 | 10 | 300 | — | — | — | — | — | — | — | — |
| | A2 | 2 | 315 | — | — | — | — | — | — | — | — |
| | A3 | 1 | 330 | 0 | 400 | 0 | 280 | 0 | 280 | 0 | 320 |
| | A4 | 0 | 360 | 0 | 410 | 0 | 255 | 0 | 270 | 0 | 310 |
| | A5 | 1 | 340 | 0 | 420 | 0 | 290 | 0 | 260 | 0 | 300 |
| | A6 | 60 | 50 | 55 | 80 | 45 | 110 | 50 | 120 | 40 | 140 |
| | A7 | 2 | 370 | 0 | 410 | 0 | 355 | 0 | 270 | 0 | 300 |
| | A8 | 1 | 380 | 0 | 410 | 0 | 290 | 0 | 275 | 0 | 320 |
| | A9 | 0 | 360 | 0 | 390 | 0 | 320 | 0 | 260 | 0 | 310 |
| | A10 | 5 | 320 | — | — | — | — | — | — | — | — |
| | A11 | 4 | 320 | — | — | — | — | — | — | — | — |
| | A12 | 3 | 340 | — | — | — | — | — | — | — | — |
| | A13 | 1 | 380 | — | — | — | — | — | — | — | — |
| | A14 | 30 | 150 | — | — | — | — | — | — | — | — |

TABLE 5-continued

SCC Test Results of Sample ① After Neutron Irradiation (320° C., 5 × $10^{22}$ n/cm$^2$, E > 1 MeV) (SSRT in High Temperature and Pressure Pure Water: 360° C., 160 kgf/cm$^2$G, strain rate 0.5 μm/min)

| | | Heat Treatment α | | Heat Treatment β | | Heat Treatment γ | | Heat Treatment δ | | Heat Treatinent η | |
|---|---|---|---|---|---|---|---|---|---|---|---|
| | | IGSCC Fracture Surface Ratio (%) | Fractue Time (h) | IGSCC Fracture Surface Ratio (%) | Fractue Time (h) | IGSCC Fracture Surface Ratio (%) | Fractue Time (h) | IGSCC Fracture Surface Ratio (%) | Fractue Time (h) | IGSCC Fracture Surface Ratio (%) | Fractue Time (h) |
| | A15 | 20 | 200 | — | — | — | — | — | — | — | — |
| | A16 | 10 | 300 | — | — | — | — | — | — | — | — |
| | A17 | 25 | 260 | — | — | — | — | — | — | — | — |
| | A18 | 7 | 310 | — | — | — | — | — | — | — | — |
| | A19 | 8 | 320 | — | — | — | — | — | — | — | — |
| Reference | B3 | 4 | 330 | — | — | — | — | — | — | — | — |
| Sample No. | B4 | 3 | 360 | — | — | — | — | — | — | — | — |
| | B5 | 5 | 340 | — | — | — | — | — | — | — | — |
| SUS | 304 | 60 | 75 | — | — | — | — | — | — | — | — |
| | 316 | 65 | 70 | — | — | — | — | — | — | — | — |

20

TABLE 6

SCC Test Results of Sample ② After Neutron Irradiation (320° C., 5 × $10^{22}$ n/cm$^2$, E > 1 MeV) (SSRT in High Temperature and High Pressure Oxygen-Saturated Water: 290° C., 70 kgf/cm$^2$G, Oxygen Concentration 8 ppm, strain rate 0.5 μm/min)

| | | Heat Treatment α | | Heat Treatment β | | Heat Treatment γ | | Heat Treatment δ | | Heat Treatinent η | |
|---|---|---|---|---|---|---|---|---|---|---|---|
| | | IGSCC Fracture Surface Ratio (%) | Fractue Time (h) | IGSCC Fracture Surface Ratio (%) | Fractue Time (h) | IGSCC Fracture Surface Ratio (%) | Fractue Time (h) | IGSCC Fracture Surface Ratio (%) | Fractue Time (h) | IGSCC Fracture Surface Ratio (%) | Fractue Time (h) |
| Sample No. | B1 | 12 | 295 | — | — | — | — | — | — | — | — |
| | B2 | 2 | 310 | — | — | — | — | — | — | — | — |
| | B3 | 1 | 325 | 0 | 420 | 0 | 275 | 0 | 255 | 0 | 330 |
| | B4 | 0 | 350 | 0 | 425 | 0 | 265 | 0 | 260 | 0 | 320 |
| | B5 | 1 | 335 | 0 | 400 | 0 | 285 | 0 | 275 | 0 | 310 |
| | B6 | 65 | 40 | 50 | 80 | 45 | 100 | 40 | 130 | 30 | 120 |
| | B7 | 2 | 380 | 0 | 410 | 0 | 350 | 0 | 260 | 0 | 330 |
| | B8 | 1 | 386 | 0 | 410 | 0 | 290 | 0 | 285 | 0 | 325 |
| | B9 | 0 | 360 | 0 | 400 | 0 | 300 | 0 | 270 | 0 | 320 |
| | B10 | 5 | 315 | — | — | — | — | — | — | — | — |
| | B11 | 4 | 320 | — | — | — | — | — | — | — | — |
| | B12 | 3 | 360 | — | — | — | — | — | — | — | — |
| | B13 | 2 | 360 | — | — | — | — | — | — | — | — |
| | B14 | 25 | 130 | — | — | — | — | — | — | — | — |
| | B15 | 20 | 180 | — | — | — | — | — | — | — | — |
| | B16 | 12 | 300 | — | — | — | — | — | — | — | — |
| | B17 | 28 | 250 | — | — | — | — | — | — | — | — |
| | B18 | 7 | 300 | — | — | — | — | — | — | — | — |
| | B19 | 8 | 320 | — | — | — | — | — | — | — | — |
| | B20 | 15 | 290 | — | — | — | — | — | — | — | — |
| Reference | A3 | 2 | 380 | — | — | — | — | — | — | — | — |
| Sample No. | A4 | 1 | 385 | — | — | — | — | — | — | — | — |
| | A5 | 1 | 370 | — | — | — | — | — | — | — | — |
| SUS | 304 | 70 | 50 | — | — | — | — | — | — | — | — |
| | 316 | 85 | 30 | — | — | — | — | — | — | — | — |

Thus, the high nickel austenitic stainless steels resistant to degradation by neutron radiation according to the present invention is more excellent in degradation resistance to the neutron irradiation and tends to hardly cause stress corrosion cracking in an environment of a light-water reactor even after neutron irradiation of approximately 1×$10^{22}$ n/cm$^2$ (E>1 MeV), as the maximum value of a quantity of the neutron irradiation until the end of the plant life of light-water reactors. When using this alloy for core materials in light-water reactors, operation is possible until the end of the plant life of reactors without fear of IASCC and reliability of nuclear reactors can further be improved. Thus, this invention greatly serves to development of the present technical field.

What is claimed is:

1. A high nickel austenitic stainless steel resistant to degradation by neutron irradiation which consists of by weight % 0.005 to 0.08% of carbon, at most 0.3% of Mn, at most 0.2% of (Si+P+S), 25 to 40% of Ni, 25 to 40% of Cr, 1 to 3% of Mo, 0.1 to 1% of W, at most 0.3% of (Nb+Ta), at most 0.3% of Ti, at most 0.001% of B and the balance of Fe, and is subjected to a solution-annealing treatment at a temperature of 1000 to 1150° C., wherein said austenitic stainless steel has an average thermal expansion coefficient in a range of $15\times10^{-6}$–$19\times10^{-6}$/K from room temperature to 400° C. and a resistance of stress corrosion cracking property in high temperature and pressure water of 270–350° C./70–160 atm or in high temperature and pressure water saturated with oxygen even after neutron irradiation of approximately at least $1\times10^{22}$ n/cm$^2$ (E>1 MeV).

2. A high nickel austenitic stainless steel resistant to degradation by neutron irradiation which consists of by weight % 0.005 to 0.08% of carbon, at most 0.3% of Mn, at most 0.2% of (Si+P+S), 25 to 40% of Ni, 25 to 40% of Cr, at most 3% of Mo, at most 5% of (Mo+W), at most 0.3% of (Nb+Ta), at most 0.3% of Ti, at most 0.001% of B and the balance of Fe, and is subjected to a solution-annealing treatment at a temperature of 1000 to 1150° C., wherein said austenitic stainless steel has an average thermal expansion coefficient in a range of $15\times10^{-6}$~$19\times10^{-6}$/K from room temperature to 400° C. and a resistance of stress corrosion cracking property in high temperature and pressure water of 270~350° C./70~160 atm or in high temperature and pressure water saturated with oxygen even after neutron irradiation of approximately at least $1\times10^{22}$ n/cm$^2$ (E>1 MeV).

3. A high nickel austenitic stainless steel resistant to degradation by neutron irradiation produced by a process comprising the steps of:

forming stainless steel consisting of by weight % 0.005 to 0.08% of carbon, at most 0.3% of Mn, at most 0.2% of (Si+P+S), 25 to 40% of Ni, 25 to 40% of Cr, 1 to 3% of Mo, 0.1 to 1% of W, at most 0.3% of (Nb+Ta), at most 0.3% of Ti, at most 0.001% of B and the balance of Fe, and subjecting the stainless steel to a solution-annealing treatment at a temperature of 1000 to 1150° C. to obtain said austenitic stainless steel, wherein said austenitic stainless steel has an average thermal expansion coefficient in a range of $15\times10^{-6}$–$19\times10^{-6}$/K from room temperature to 400° C. and a resistance of stress corrosion cracking property in high temperature and pressure water of 270–350° C./70–160 atm or in high temperature and pressure water saturated with oxygen even after neutron irradiation of approximately at least $1\times10^{22}$ n/cm$^2$ (E>1 MeV).

4. The high nickel austenitic stainless steel as claimed in claim 3, further comprising cold working up to 30% the stainless steel after the solution-annealing treatment.

5. The high nickel austenitic stainless steel as claimed in claim 4, further comprising heat treating the stainless steel for a period of up to 100 hours at 600 to 750° C. after the solution-annealing treatment or cold working.

6. A process for producing a high nickel austenitic stainless steel resistant to degradation by neutron irradiation comprising:

forming stainless steel consisting of by weight % 0.005 to 0.08% of carbon, at most 0.3% of Mn, at most 0.2% of (Si+P+S), 25 to 40% of Ni, 25 to 40% of Cr, 1 to 3% of Mo, 0.1 to 1% of W, at most 0.3% of (Nb+Ta), at most 0.3% of Ti, at most 0.001% of B and the balance of Fe, and subjecting the stainless steel to a solution-annealing treatment at a temperature of 1000 to 1150° C to obtain said austenitic stainless steel, wherein said austenitic stainless steel has an average thermal expansion coefficient in a range of $15\times10^{-6}$–$19\times10^{-6}$/K from room temperature to 400° C. and a resistance of stress corrosion cracking property in high temperature and pressure water of 270–350° C./70–160 atm or in high temperature and pressure water saturated with oxygen even after neutron irradiation of approximately at least $1\times10^{22}$ n/cm$^2$ (E>1 MeV).

7. The process for producing the high nickel austenitic stainless steel of claim 6 further comprising cold working up to 30% the stainless steel after the solution-annealing treatment.

8. The process for producing the high nickel austenitic stainless steel of claim 7 further comprising heat treating the stainless steel for a period of up to 100 hours at 600 to 750° C after the solution-annealing treatment or cold working.

* * * * *